US007195292B2

(12) United States Patent
Ketelsen et al.

(10) Patent No.: US 7,195,292 B2
(45) Date of Patent: Mar. 27, 2007

(54) LATCH BOLT

(75) Inventors: Morten Ketelsen, Muenster (GB); John Gorton, Cumberland (GB)

(73) Assignee: ArvinMeritor Light Vehicle Systems (UK) Ltd., West Midlands (GB)

( * ) Notice: Subject to any disclaimer, the term of this patent is extended or adjusted under 35 U.S.C. 154(b) by 0 days.

(21) Appl. No.: 10/943,786

(22) Filed: Sep. 17, 2004

(65) Prior Publication Data

US 2005/0062295 A1 Mar. 24, 2005

(30) Foreign Application Priority Data

Sep. 19, 2003 (GB) ..... 0321909.4

(51) Int. Cl.
*E05C 3/16* (2006.01)
*E05B 65/32* (2006.01)

(52) U.S. Cl. ..... 292/216; 292/201; 292/DIG. 23; 292/DIG. 56

(58) Field of Classification Search ..... 292/216, 292/201, 213, DIG. 23, DIG. 56, DIG. 57, 292/231
See application file for complete search history.

(56) References Cited

U.S. PATENT DOCUMENTS 4,358,141 A * 11/1982 Hamada ..... 292/216
5,020,838 A * 6/1991 Fukumoto ..... 292/201
5,035,453 A * 7/1991 Fukumoto et al. ..... 292/336.3
5,308,128 A * 5/1994 Portelli et al. ..... 292/216
5,348,357 A * 9/1994 Konchan et al. ..... 292/216
5,544,925 A * 8/1996 Ikeda ..... 292/216
5,642,636 A * 7/1997 Mitsui ..... 70/237
6,789,825 B2 * 9/2004 Kalargeros et al. ..... 292/216

FOREIGN PATENT DOCUMENTS

| | | | |
|---|---|---|---|
| EP | 0 995 870 | | 4/2000 |
| EP | 1 136 640 | | 9/2001 |
| GB | 2 321 928 | | 8/1998 |
| IT | EP 894925 | * | 2/1999 |
| JP | 4131484 | * | 4/1992 |
| JP | 5156854 | * | 5/1993 |
| JP | 2003113687 | * | 4/2003 |

OTHER PUBLICATIONS

United Kingdom Search Report dated Mar. 5, 2004.

* cited by examiner

*Primary Examiner*—Brian E. Glessner
*Assistant Examiner*—Carlos Lugo
(74) *Attorney, Agent, or Firm*—Carlson, Gaskey & Olds

(57) ABSTRACT

A latch mechanism includes a chassis and a latch bolt movably mounted on the chassis. The chassis includes an abutment, and the latch bolt is moveable between an open position in which the latch bolt can receive a striker of a vehicle, a closed position at which the striker is capable of being retained by the latch bolt, and an over-travel position. The latch mechanism includes a buffer having a displacing element and an engagement portion. The buffer is capable of operably acting between the abutment and the latch bolt to absorb over-travel of the latch bolt. The displacing element is capable of moving frictionally against the engagement portion during over-travel to generate a frictional force to absorb over-travel energy of the latch bolt.

18 Claims, 6 Drawing Sheets

LATCH BOLT

REFERENCE TO RELATED APPLICATIONS

This application claims priority to Great Britain patent application GB 0321909.4 filed on Sep. 19, 2003.

TECHNICAL FIELD

This invention relates generally to latch mechanisms and latch bolts for latch mechanisms that are primarily intended for use on a closure of a motor vehicle.

BACKGROUND OF THE INVENTION

A latch bolt for a car door includes one or more energy-absorbing buffers to lower noise during operation of the latch mechanism of the latch bolt. The energy-absorbing buffers can be located in a variety of positions on the latch bolt, depending on what type of impact the energy-absorbing buffers are intended to absorb energy from. Energy-absorbing buffers are commonly located to absorb some of the impact between the latch bolt and an open latch abutment as the latch bolt moves, under spring bias, from a closed position to an open position. At the closed position, a striker mounted on the door frame is retained by the latch bolt. When the latch bolt moves into the closed position, a pawl moves past a first safety abutment of the latch bolt and is spring biased to engage a closed abutment of the latch bolt to maintain the latch bolt in the closed position. Energy-absorbing buffers are sometimes located to absorb some of the impact between the first safety abutment or the closed abutment of the latch bolt and the pawl.

An energy-absorbing buffer has also been provided to absorb energy from over-travel of the latch beyond the closed position, which can occur when the closure is slammed shut. The momentum of a closure shutting is normally much greater than the momentum of the latch bolt springing open or of the pawl engaging with the latch bolt. Therefore, an energy-absorbing buffer designed to absorb impact from over-travel needs to be able absorb much more energy than the energy-absorbing buffers described above.

Known energy-absorbing buffers (such as described in EP 0995879) include an aperture or cavity in the latch bolt which collapses under impact. These single cavity based buffers have difficulty absorbing large impacts and therefore only have limited use as over-travel buffers. The single cavity based buffers rely solely on deformation of the buffer to absorb energy.

To absorb the additional energy, over-travel buffers may have cavities of a more complex shape and/or include additional cavities (such as described in EP 1136640). These buffers are better suited for use as over-travel buffers, but still rely solely on absorbing energy by deformation. Consequently, they are not ideal in certain applications.

SUMMARY OF THE INVENTION

The present invention provides improvements in latch bolts and the latch mechanisms contained in the latch bolts. More particularly, the present invention provides improvements particular to the buffers and even more particularly, but not exclusively, to over-travel buffers of the latch bolts.

The present invention provides a latch mechanism suitable for a vehicle including a chassis and a latch bolt. The latch bolt is movably mounted on the chassis, and the chassis includes an abutment for an over-travel buffer. The latch bolt is moveable between an open position in which the latch bolt can receive a striker of a vehicle, a closed position in which the striker is capable of being retained by the latch bolt, and an over-travel position. The latch mechanism includes an over-travel buffer which has a displacing element and an engagement portion. The over-travel buffer operably acts between the abutment of the chassis and the latch bolt to absorb over-travel of the latch bolt. The displacing element is moveable frictionally against the engagement portion during over-travel and generates frictional force to absorb over-travel energy of the latch bolt.

These and other features of the present invention will be best understood from the following specification and drawings.

BRIEF DESCRIPTION OF THE DRAWINGS

Embodiments of the invention will now be described, by way of example only, with reference to the accompanying drawings in which.

DETAILED DESCRIPTION OF THE PREFERRED EMBODIMENT

Figure 1:
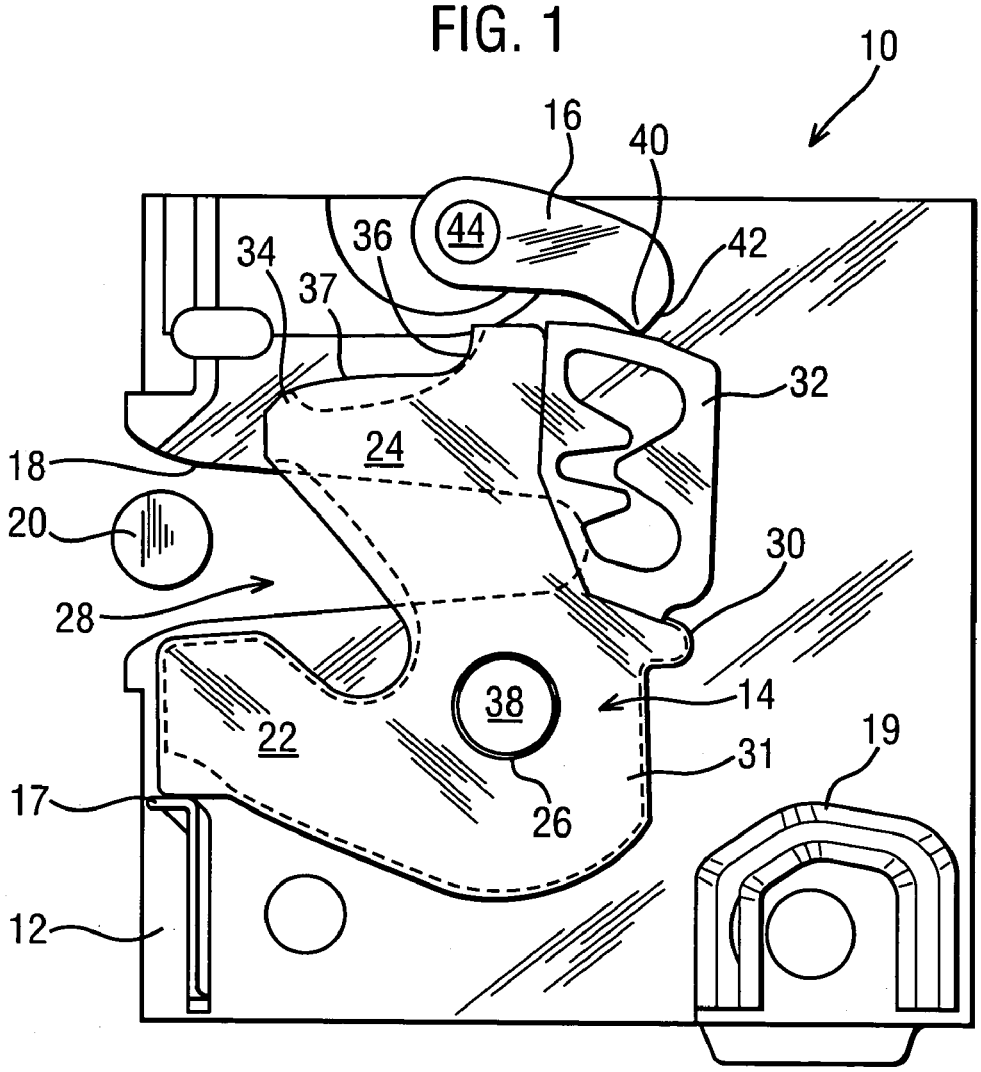
FIG. 1 shows a view of a latch mechanism according to the invention with a latch bolt in an open position.
Figure 2:
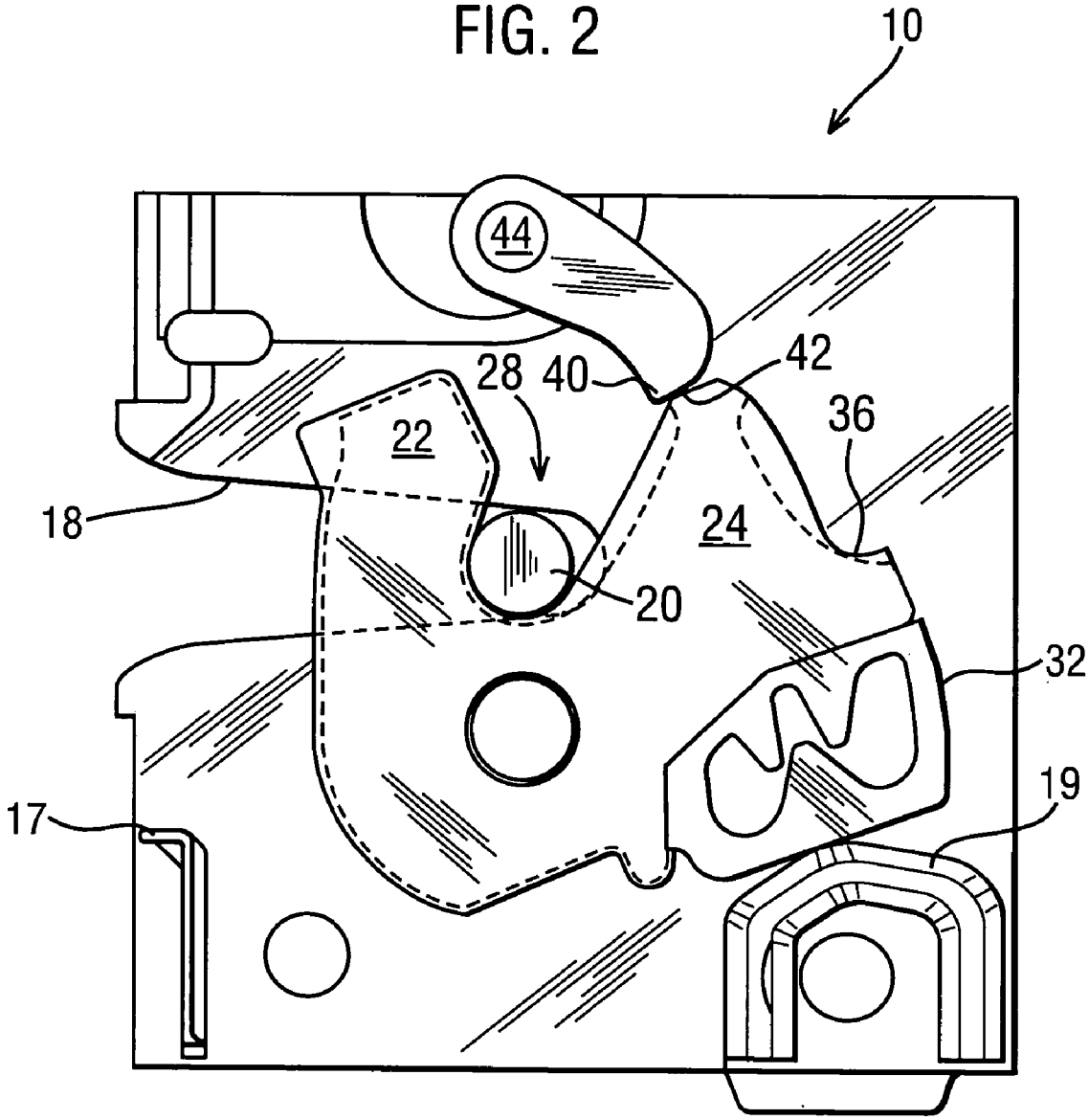
FIG. 2 shows a view of the latch mechanism of FIG. 1 with the latch bolt in a closed position.
Figure 3:
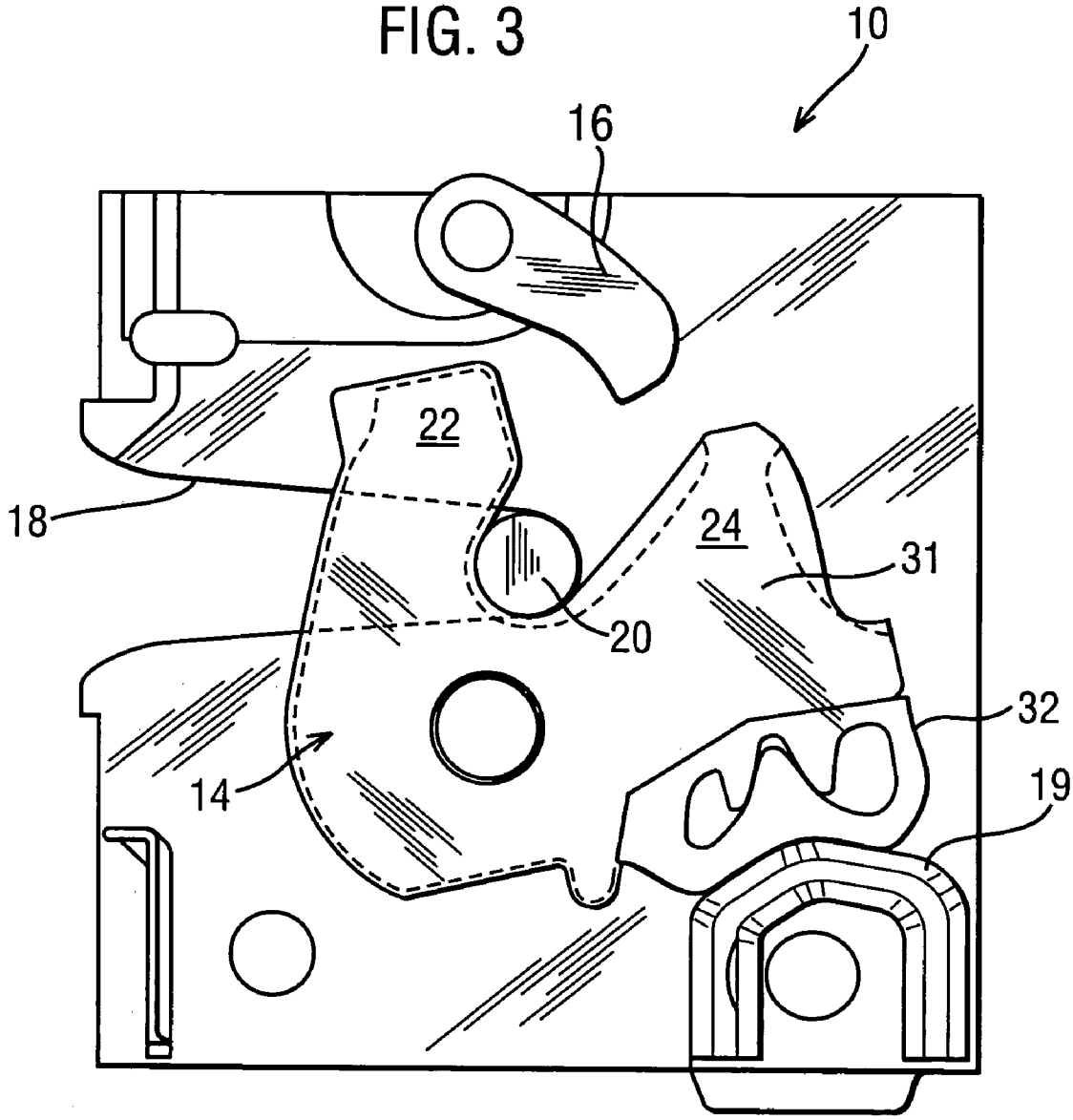
FIG. 3 shows a view of the latch mechanism of FIG. 1 with the latch bolt in an over-travel position.

Referring to FIGS. 1 to 3, a latch mechanism 10 includes a chassis 12 having a latch bolt 14, in the form of a rotating claw, and a pawl 16 mounted on the chassis 12.

The chassis 12 includes a retention plate having a lateral slot (or striker mouth) 18 that is capable of permitting entry of a striker 20. The chassis 12 also includes an open latch abutment 17 and an over-travel abutment 19. The over-travel abutment 19 may include an elastomeric material that can absorb some energy of an impact.

However, in further embodiments, the over-travel abutment 19 can be rigid, thus requiring an over-travel buffer 32 (see below) to provide all of the over-travel buffering requirements.

The latch bolt 14 includes a shaped metal substrate (not shown) having a central hole 26 and two arms 22 and 24 that define a recess 28. An overmold 30 of an elastomeric material surrounds the metal substrate. The overmold 30 includes a main body 31 and the over-travel buffer 32. The arm 24 includes a closed abutment 34 and a safety abutment 36, and a surface 37 is disposed between the closed surface 34 and the safety abutment 36.

The latch bolt 14 is rotatably mounted on a first pivot 38 located in the central hole 26. The latch bolt 14 is biased by a spring (not shown) counter-clockwise about the first pivot 38.

The pawl 16 includes a shaped metal substrate which includes a pawl tooth 40 and a pawl shoulder 42. The pawl 16 is substantially coplanar with the latch bolt 14 and is rotatably mounted to the chassis 12 about a second pivot 44. The pawl 16 is biased clockwise about the second pivot 44 by a second spring (not shown).

In use, the latch mechanism 10 is mounted on a door (not shown) of a motor vehicle (not shown). The striker 20 is fixed on the frame of the door and is aligned with the slot 18.

In the open position of the latch mechanism 10 shown in FIG. 1, the arm 22 of the latch bolt 14 abuts and is biased against the open latch abutment 17. In this position, the entrance to the recess 28 is aligned with the slot 18, and the pawl tooth 40 abuts the over-travel buffer 32.

As the door of the motor vehicle is closed, the striker 20 moves into the slot 18 and the recess 28 of the latch bolt 14. The striker 20 then strikes the latch bolt 14 and pushes the latch bolt 14 clockwise about the first pivot 38 against the biasing of the spring. As the latch bolt 14 rotates clockwise, the pawl tooth 40 traces a periphery of the over-travel buffer 32 until it reaches the safety abutment 36, when the pawl 16 is forced clockwise by the second spring, and engages the surface 37 of the arm 24. As the latch bolt 14 continues to rotate clockwise, the pawl tooth 40 will move past the surface 37.

If the door is not shut with sufficient force such that the latch bolt 14 does not rotate far enough clockwise for the pawl tooth 40 to reach the closed abutment 34, the elastomeric door seals (weather seals) situated around the periphery of the door will tend to open the door such that the latch bolt 14 rotates back counter-clockwise until the pawl shoulder 42 of the pawl 16 abuts the safety abutment 36 of the latch bolt 14. The engagement between the pawl shoulder 42 and the safety abutment 36 prevents the latch bolt 14 from rotating back counter-clockwise any further, and the latch mechanism 10 stays in a safety position (not depicted in the Figures) in which the door is not fully shut, but nevertheless will not open.

If the door is shut with sufficient force to close properly, the latch bolt 14 will rotate clockwise so that the closed abutment 34 moves past the pawl tooth 40, and the pawl 16 rotates clockwise once the closed abutment 34 has passed. The latch mechanism 10 is then in the closed position, as depicted in FIG. 2, in which the striker 20 is fully retained by the latch bolt 14 and the door is kept closed. The pawl shoulder 42 of the pawl 16 abuts the arm 24 and prevents the latch bolt 14 from rotating counter-clockwise.

Once the pawl tooth 40 has passed the closed abutment 15, the weather seals are primarily responsible for preventing the latch bolt 14 from rotating further clockwise. However, if the door is slammed shut with excessive force, the latch bolt 14 will over-travel past the closed position until the over-travel buffer 32 hits the over-travel abutment 19. Under such circumstances, the impact of the over-travel buffer 32 with the over-travel abutment 19 can be a high energy impact. The over-travel buffer 32 compresses on impact, for example to a position shown in FIG. 3, thereby absorbing energy. Energy is also dissipated as heat due to frictional forces as described below with reference to FIG. 5. Such absorption and dissipation of energy means that the impact is significantly quieter.

After over-travel, the weather seals will rotate the latch bolt 14 counter-clockwise until the closed abutment 15 abuts the pawl shoulder 42 so that the latch mechanism 10 is in the closed position. The over-travel buffer 32 will then have relaxed back to its uncompressed condition shown in FIG. 2. The latch mechanism 10 can be returned to the open position by rotating the pawl 16 counter-clockwise against its biasing direction so that the latch bolt 14 is free to rotate counter-clockwise, thereby releasing the striker 20.

Figure 4:
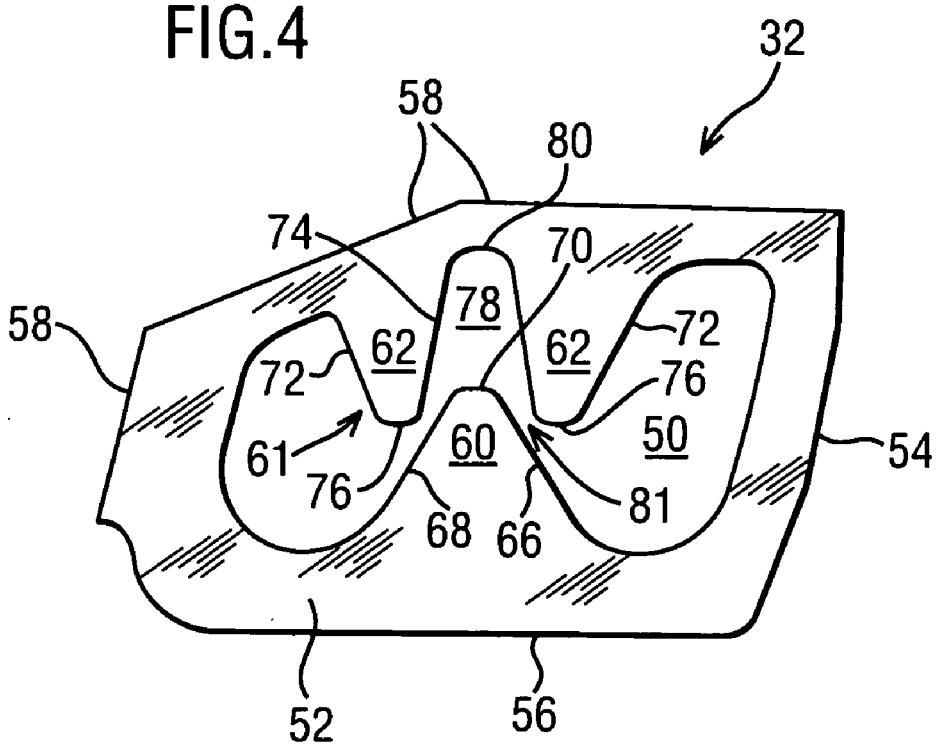
FIG. 4 is a close up view of a buffer systems of the latch bolt of FIGS. 1, 2 and 3 when not compressed.

In FIG. 4, the over-travel buffer 32 of the latch bolt 14 can be seen in more detail. The over-travel buffer 32 includes a single loop 52 of elastomeric material surrounding a cavity 50. The single loop 52 has an edge with a side surface 54, an abutment surface 56, and three attachments surfaces 58. The over-travel buffer 32 is attached to (by being integrally molded with) the rest of the overmold 30 of the latch bolt 14 via the three attachment surfaces 58, as can be seen in FIGS. 1, 2 and 3. The abutment surface 56 is the surface that abuts the over-travel abutment 19 in the over-travel position, as shown in FIG. 3.

A displacing element in the form of a wedge 60 that is near the abutment surface 56 and an engagement portion 61 that is located near the three attachment surfaces 58 project into the cavity 50, but still form an integral part of the single loop 52. The wedge 60 and the engagement portion 61 face directly opposite each other across the cavity 50. The wedge 60 includes two tapered side surfaces 66 and 68 which form part of the boundary wall of the cavity 50 and meet at a peak 70.

The engagement portion 61 includes two cantilevered beams 62. Each cantilevered beam 62 has an outer side surface 72 and an inner engagement surface 74. Corresponding pairs of the outer side surface 72 and the inner engagement surface 74 each meet at a peak 76. The two cantilevered beams 62 are separated by a receiving portion 78 of the cavity 50, and the receiving portion 78 is disposed between the two inner engagement surfaces 74. The receiving portion 78 has an end 80, from which the two cantilever beams 62 are cantilevered, and an entrance 81 defined by the peaks 76.

During movement into the over-travel position shown in FIG. 3, the over-travel buffer 32 is compressed against the over-travel abutment 19 as described above. The abutment surface 56 impacts the over-travel abutment 19, while the remainder of the latch bolt 14 continues to rotate. Consequently, the three attachment surfaces 58 move closer to the abutment surface 56, deforming the elastomeric material of the single loop 52 and altering the shape of the cavity 50.

During compression, the wedge 60 is forced into the receiving portion 78 of the cavity 50. In doing so, the tapered side surfaces 66 and 68 of the wedge 60 contact the inner engagement surfaces 74 of the two cantilevered beams 62. When the force of the over-travel impact is sufficiently great, the tapered side surfaces 66 and 68 move along the inner engagement surfaces 74, even after such engagement. Clearly, a frictional force acts against these surfaces when they move relative to each other. Therefore, a significant amount of the force of the over-travel impact must be used to overcome this friction. Consequently, some of the kinetic energy of the latch bolt 14 is dissipated by the friction as heat.

The entrance 81 of the receiving portion 78 is significantly larger than the end 80, and the inner engagement surfaces 74 taper between the two. Since the tapered side surfaces 66 and 68 of the wedge 60 also taper outwardly from the peak 70, the wedge 60 cannot move more than a certain amount between the two cantilevered beams 62 without deformation or displacement of the two cantilevered beams 62. If the force of the over-travel is great enough then displacement occurs, and the two cantilevered beams 62 are bent outwardly relative to one another to increase the size of the receiving region between them. Once the two cantilevered beams 62 are displaced, the wedge 60 is able to be forced further into the receiving portion 78 until the peak 70 is near the end 80 of the cavity 50 in the position shown in FIG. 5.

Figure 5:
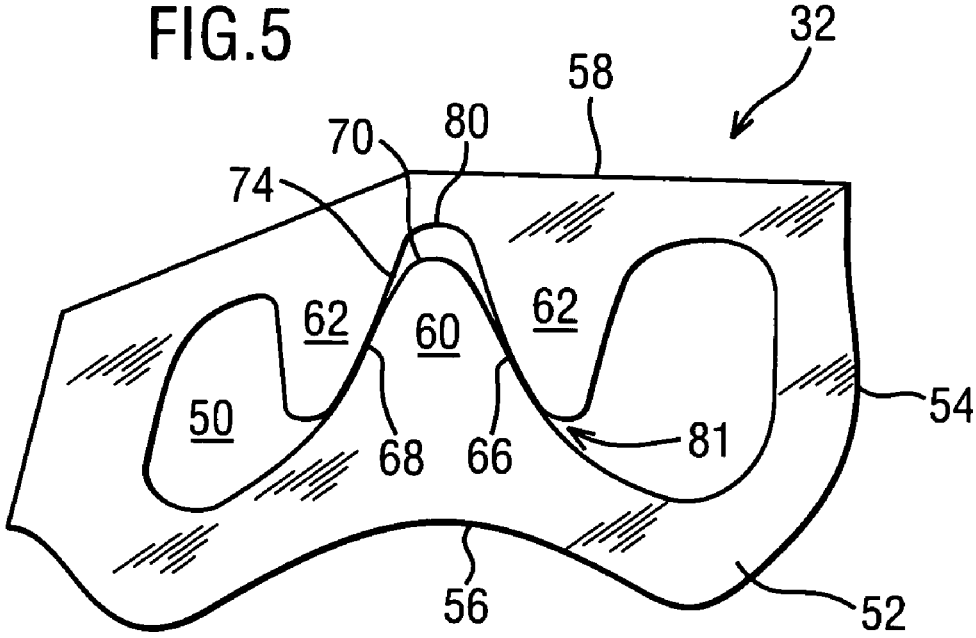
FIG. 5 is a close up view of the buffer system of the latch bolt of FIG. 4 when compressed as during over-travel.

In FIG. 5, the over-travel buffer 32 is shown in its compressed state as caused by the impact of over-travel. As shown, the abutment surface 56, which has been deformed from being relatively straight in FIG. 4 to being significantly concave in FIG. 5, absorbs some over-travel energy of the latch bolt 14. The middle of the abutment surface 56 is significantly closer to the attachment surfaces 58 than before compression. The single loop 52 is shown significantly deformed and is bowed out slightly at the side surface 54. Within the cavity 50, the peak 70 of the wedge 60 has moved from the position near the entrance 81 to a position near the end 80 of the receiving portion 78. The two cantilevered beams 62 have been bent away from each other with the inner engagement surfaces 74 in frictional engagement with the tapered side surfaces 66 and 68 of the wedge 60.

As described above, the over-travel buffer 32 will relax back to its uncompressed condition after the latch bolt 14 rotates to the closed position. The biasing of the elastomeric material back to its relaxed state, both of the single loop 52 returning to a state in which the abutment surface 56 is no longer concave but relatively straight and from the two cantilevered beams 62 moving back to the position as depicted in FIG. 4, is strong enough to overcome any frictional force between the tapered side surfaces 66 and 68 and the outer side surfaces 72.

Significantly, energy is not just absorbed by the collapse of the cavity 50 and the consequent deformation of the cavity 50 as might occur with a conventional buffer. Energy is also dissipated in overcoming the frictional force between the tapered side surfaces 66 and 68 and the outer side surfaces 72 and further in being absorbed by the deformation of the two cantilevered beams 62 caused by the forcible engagement with the wedge 60.

The abutment surface 56 is substantially flat and parallel with an axis of rotation X of the latch bolt 14. The abutment surface 56 collides with the over-travel abutment 19 during over-travel and transmits the force of the impact into the over-travel buffer 32.

Figure 6:
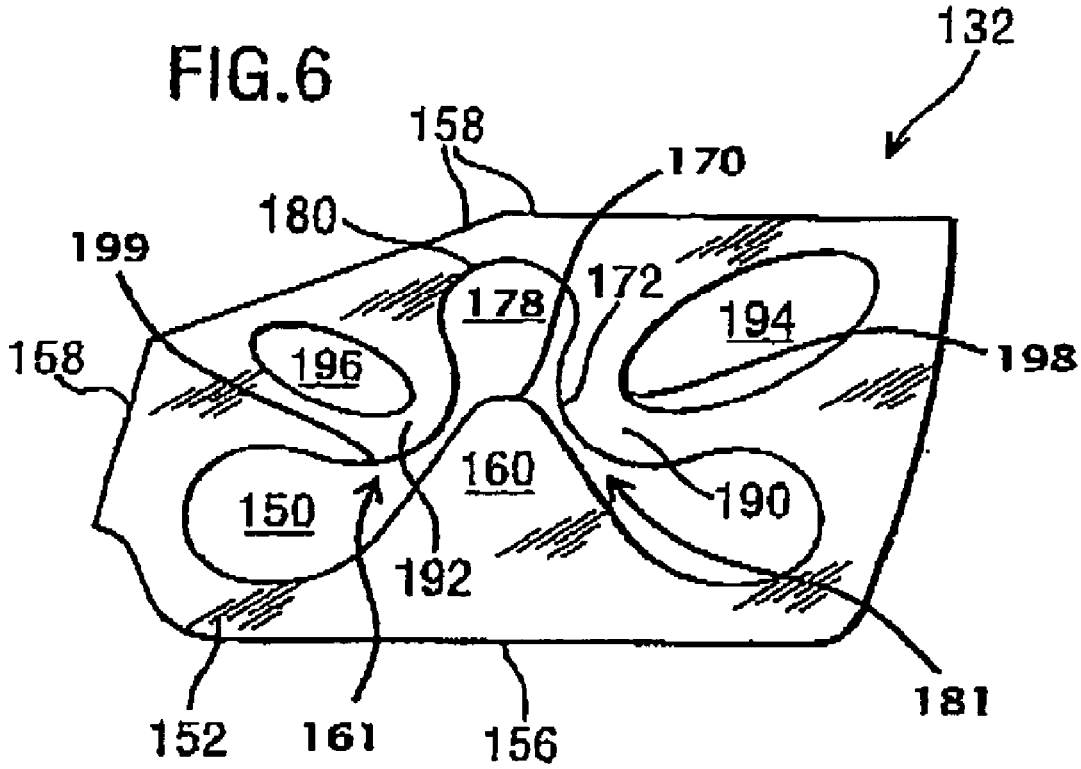
FIG. 6 is a close up view of a second embodiment of a buffer system of a latch bolt according to the invention when not compressed.
Figure 7:
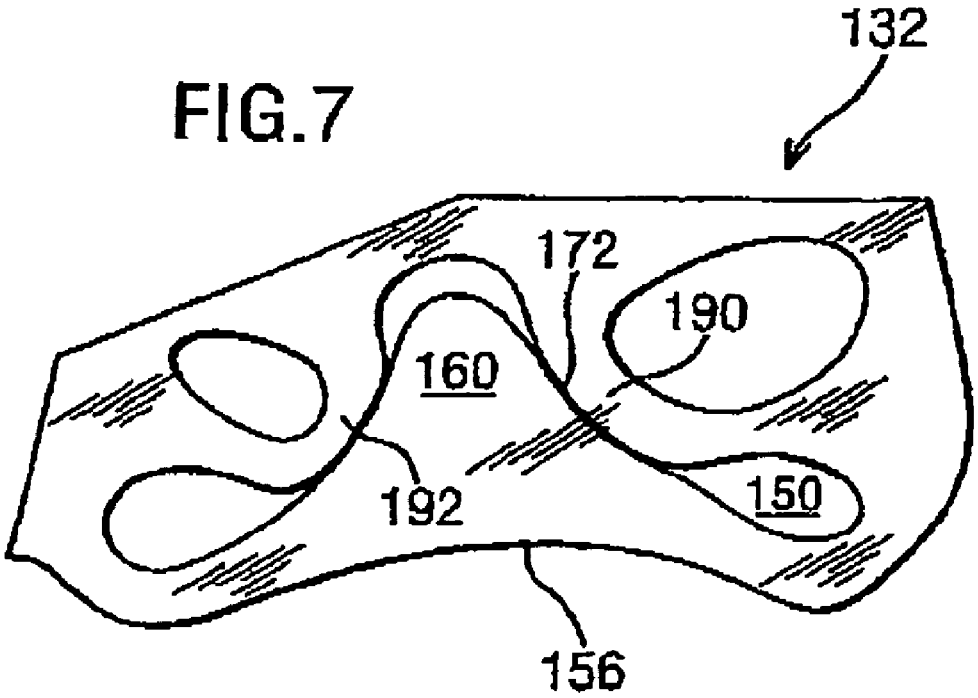
FIG. 7 is an enlarged view of the second embodiment of the buffer system of FIG. 6 when compressed.

In FIG. 6 illustrates a second embodiment of an over-travel buffer 132. The over-travel buffer 132 is used in the same manner as the over-travel buffer 32, and FIGS. 1, 2 and 3 and the accompanying description are equally applicable. Components that are similar to the components of the first embodiment of the over-travel buffer 32 are given the same reference number as the corresponding component and prefixed by a 1.

The over-travel buffer 132 has a central cavity 150 delimited by an integral piece of elastomeric material 152. The piece of elastomeric material 152 includes a wedge 160 and an engagement portion 161 that are in a similar position to the wedge 60 and the engagement portion 61 of the over-travel buffer 32. Instead of two cantilevered beams 62, the piece of elastomeric material 152 has loops 190 and 192 encompassing a second and third cavity 194 and 196, respectively.

The two loops 190 and 192 are separated by a receiving portion 178 of the central cavity 150. The receiving portion 178 has an entrance 181 near the peak 170 of the wedge 160 and a concave end 180. The two loops 190 and 192 have an inner surface 198 that defines the walls of cavities 194 and 196 and an outer surface 199 that forms part of the wall of the central cavity 150. Part of the outer surface 199 constitutes engagement surfaces 172 defining the sides of the receiving portion 178. The engagement surfaces 172 initially taper inwardly between the entrance 179 and the concave end 180 of the receiving portion 178, causing the receiving portion 178 to be significantly narrower in the middle than at the entrance 179. The engagement surfaces 172 extend away from each other such that the concave end 180 is wider than the entrance 179.

The second and third cavities 194 and 196 are substantially elliptical and are located behind the engagement surfaces 172 with respect to the direction of engagement with the wedge 160. The cavities 194 and 196 reduce the stiffness of the structure of the over-travel buffer 32 and distribute stress caused by the deformation and over-travel.

When compressed by an impact of over-travel, the over-travel buffer 132 acts in a similar way to the over-travel buffer 32, except that instead of the two cantilevered beams 62 being bent outwardly, the loops 190 and 192 are pushed outwardly with respect to each other, compressing the cavities 194 and 196. As with the first embodiment of the over-travel buffer 32, the energy is absorbed by the additional deformation of the over-travel buffer 32 that is caused by the displacement by the wedge 160 in addition to the collapse of the central cavity 150. Beneficially, energy is also dissipated by the frictional engagement of the surfaces of the wedge 60 and the engagement surfaces 172.

In an alternative embodiment, the over-travel buffers 132 and 32 can be defined in the reverse way with the wedge 60 and 160 being proximate to the attachment surfaces 58 and 158 and the engagement potion 161 being located proximate the abutment surface 56 and 156. In further alternative embodiments, the over-travel buffer 32 or 132 can be located on the over-travel abutment 19 of the chassis 12 instead of being located on the latch bolt 14. Accordingly, the over-travel buffer 32 and 132 will not rotate with the latch bolt 14 and will remain stationary with the chassis 12. However, the compression that occurs on impact between the over-travel abutment 19 and the latch bolt 14 works in a substantially similar manner to the embodiment described in more detail with FIGS. 1, 2, 3, 4 and 5 in a similar manner, and energy will be absorbed by the deformation of the over-travel buffer 32 and 132 and by dissipation in frictional forces.

Figure 8:
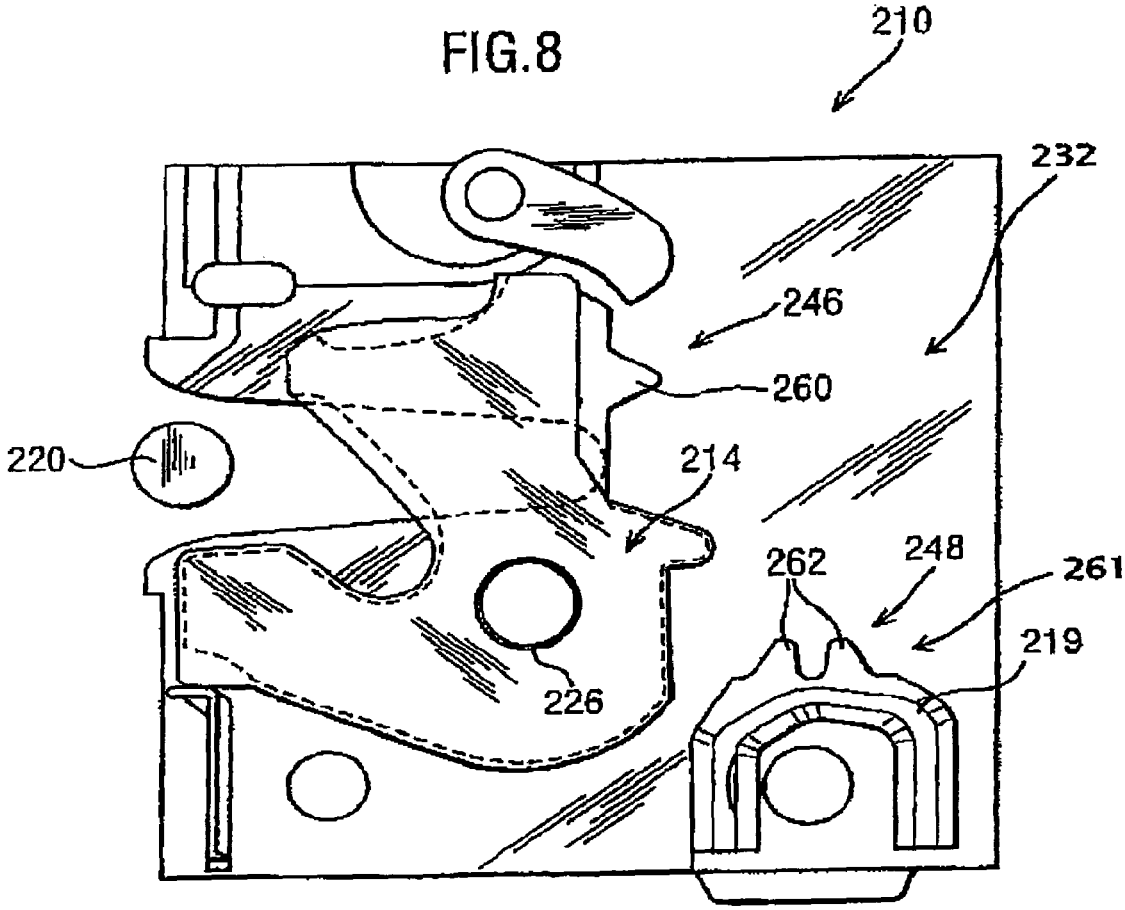
FIG. 8 is view of a latch mechanism with a third embodiment of a buffer system.

A further embodiment of the invention is shown in FIG. 8. In this embodiment, the latch mechanism 210 works in substantially the same way as described-above, with a striker 220 and a central hole 226, but has a different buffer system. Components which are similar to the components of the first embodiment of latch bolt 14 are given the same reference number as the corresponding component, but prefixed by a 2.

The over-travel buffer 232 is not of an integral one piece construction, but instead has two separate components: a first component 246 and a second component 248. The first component 246 includes a wedge 260 substantially identical to the wedges 60 and 160 of the earlier embodiments. The first component 246 is located on the latch bolt 214 in substantially the same location as the over-travel buffer 32, as shown in FIGS. 1, 2 and 3.

The second component 248 includes an engagement portion 261 which is substantially similar to the engagement portion 61 of the over-travel buffer 32. The second component 248 is located on the abutment 219. This embodiment of the latch mechanism 210 works substantially in the same way as the latch mechanism 10 with the over-travel buffer 32 as described in FIGS. 1, 2, 3 and 4. During over-travel, the wedge 260 and the engagement portion 261 engage frictionally, with the cantilevered beams 262 being bent outwardly in the same manner as described in FIGS. 4 and 5. There is no equivalent deformation of the over-travel buffer 232 to the deformation of the cavity 50 of the over-travel buffer 32, and the side walls are not bowed outwardly. Consequently, the impact of the over-travel is borne solely by the deformation of the cantilevered beams 262 outwardly in dissipation of the energy by the frictional engagement of the wedge 260 and the engagement portion 261 and by the elastomeric nature of the material.

In an alternative embodiment, the components 246 and 248 can be located in opposite positions, i.e. the first component 246 on the abutment 219 and the second component 248 on the latch bolt 214. Such an alternative arrangement works in a very similar manner as that described in FIG. 8.

While the over-travel buffer 232 is designed to absorb high impacts and therefore is particularly beneficial when used as an over-travel buffer as described here, the over-travel buffer 32, 132 or 232 could also be located elsewhere on the overmold 30, for example on the arm 22 or the arm 24 and in particular the surface 37, to absorb energy from the lower impacts from the latch bolt 14 hitting the open latch abutment 17 and the pawl 16.

While the invention has been described with reference to a rotary latch bolt, it is not limited only to use with such a rotary latch bolt.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A latch mechanism for use on a vehicle, the latch mechanism comprising:

a chassis including an abutment;

a latch bolt movably mounted on the chassis and moveable between an open position in which the latch bolt can receive a striker of a vehicle, a closed position in which the striker is retainable by the latch bolt, and an over-travel position; and a buffer including a displacing element and an engagement portion, wherein the buffer operably acts between the abutment and the latch bolt to absorb energy during movement of the latch bolt to the over-travel position, and wherein the displacing element is moveable frictionally against the engagement portion during movement to the over-travel position to generate a frictional force to absorb energy as the latch bolt moves to the over-travel position, wherein the engagement portion includes two engagement surfaces, the displacing element is frictionally moveable against the two engagement surfaces of the engagement portion during movement of the latch bolt to the over-travel position, and the two engagement surfaces surround the displacing element during movement of the latch bolt to the over-travel position.

2. The latch mechanism according to claim 1 wherein the displacing element and the engagement portion are integrally formed.

3. The latch mechanism according to claim 1 wherein the displacing element and the engagement portion are mounted on the latch bolt.

4. The latch mechanism according to claim 3 wherein the latch bolt includes an overmold and the buffer is part of the overmold on the latch bolt, and the overmold is formed of an elastomeric material.

5. The latch mechanism according to claim 1 wherein the displacing element and the engagement portion are mounted on the abutment of the chassis.

6. The latch mechanism according to claim 1 wherein one of the displacing element and the engagement portion is mounted on the latch bolt, and the other of the displacing element and the engagement portion is mounted on the abutment of the chassis.

7. The latch mechanism according to claim 1 wherein the displacing element is substantially wedge shaped.

8. The latch mechanism according to claim 1 wherein the two engagement surfaces are displaced relative to each other by the displacing element during movement of the latch bolt to the over-travel position.

9. The latch mechanism according to claim 1 wherein the engagement portion includes two cantilevered beams, and the two engagement surfaces form inner edges of the two cantilevered beams.

10. The latch mechanism according to claim 1 wherein the engagement portion includes cavities that are deformable on engagement between the displacing element and the engagement portion.

11. The latch mechanism according to claim 1 wherein the displacing element and the engagement portion form a part of the buffer, and the displacing element and the engagement portion are located opposite each other and face in a direction of engagement.

12. The latch mechanism according to claim 1 wherein the buffer includes a cavity located between the displacing element and the engagement portion.

13. The latch mechanism according to claim 1 wherein the buffer includes a deformable surface that contacts the abutment of the chassis during movement of the latch bolt to the over-travel position, and the deformable surface is concavely deformable towards the engagement portion during movement of the latch bolt to the over-travel position.

14. The latch mechanism according to claim 1 wherein the latch bolt is rotatable about an axis of rotation, and the latch bolt rotates between the open position, the closed position and the over-travel position.

15. A latch bolt for a vehicle latch, the latch bolt being moveable between an open position in which the latch bolt can receive a striker of a vehicle, a closed position in which the latch bolt can retain the striker, and an over-travel position, the latch bolt comprising:

a buffer capable of operably acting between the latch bolt and a portion of a vehicle latch to absorb travel of the latch bolt, the buffer including:

a displacing element, and an engagement portion, wherein the displacing element is frictionally moveable against the engagement portion when the buffer acts between the latch bolt and the portion of the vehicle latch to generate a frictional force to absorb energy of the latch bolt, wherein the engagement portion includes two engagement surfaces, and the displacing element is frictionally moveable against the two engagement surfaces of the engagement portion during movement of the latch bolt to the over-travel position, the two engagement surfaces surround the displacing element during movement of the latch bolt to the over-travel position.

16. The latch bolt according to claim 15 wherein the buffer operably acts between the latch bolt and the portion of the vehicle latch during movement to the over-travel position, and the frictional force absorbs energy as the latch bolt moves to the over-travel position.

17. The latch mechanism according to claim 1 wherein the displacing element slides against the engagement portion to generate the frictional force.

18. The latch bolt according to claim 15 wherein the displacing element slides against the engagement portion to generate the frictional force.

* * * * *